United States Patent [19]

Corzine et al.

[11] Patent Number: 5,021,796

[45] Date of Patent: Jun. 4, 1991

[54] BROAD BAND, POLARIZATION DIVERSITY MONOPULSE ANTENNA

[75] Inventors: Robert G. Corzine, China Lake; Bruce E. Bolstad; John S. Johantgen, both of Ridgecrest, all of Calif.

[73] Assignee: The United States of america as represented by the Secretary of the Navy, Washington, D.C.

[21] Appl. No.: 106,883

[22] Filed: Jan. 15, 1971

[51] Int. Cl.[5] ..... H01Q 1/32; H01Q 13/10; H01Q 11/10

[52] U.S. Cl. ..... 343/712; 343/725; 343/728; 343/771; 343/792.5

[58] Field of Search ..... 343/792.5, 725, 728, 343/712, 771

[56] References Cited

U.S. PATENT DOCUMENTS 3,172,113 3/1965 Heinard et al. ..... 343/771
3,482,248 12/1969 Jones, Jr. ..... 343/725 X

*Primary Examiner*—Linda J. Wallace
*Attorney, Agent, or Firm*—Sol Sheinbein; Melvin J. Sliwka

[57] ABSTRACT

A broadband, polarization diversity, monopulse antenna comprising a body canceled current array and radial arm-coupled log periodic loop antenna in combination with associated mode forming, beam forming and feed networks.

4 Claims, 6 Drawing Sheets

BROAD BAND, POLARIZATION DIVERSITY MONOPULSE ANTENNA

STATEMENT OF GOVERNMENT INTEREST

The invention described herein may be manufactured and used by or for the Government of the United States of America for governmental purposes without the payment of any royalties thereon or therefor.

CROSS REFERENCE TO RELATED APPLICATIONS

Application Ser. No. 151,480, filed June 9, 1971, now U.S. Pat. No. 3,745,584, "Radial Arm-coupled Log Periodic Loop Antenna," by R. G. Corzine.

BACKGROUND OF THE INVENTION

The present invention is concerned with the problems associated with antiradiation missle (ARM) guidance. Two basic problem areas in this field are (1) the radome design associated with missile multi-octave microwave direction finding antennas and (2) coupling between the antenna and missile body in the VHF band. The fixed body antenna concept was initially pursued because it seemed to offer solutions to the above two problems and in addition, fixed body antennas are simple and relatively inexpensive to fabricate. Moreover, the cost and complexity of a gimbal for a gimbaled antenna system is eliminated.

DESCRIPTION OF THE PRIOR ART

Presently, ARMs incorporate a monopulse direction finding system using logarithmic spiral antennas. These antennas are basically similar to those illustrated in U.S. Pat. No. 3,344,425 with the associated beam forming and phasing networks. However, the spiral antennas now in use suffer drop out of the difference pattern at low frequencies.

DESCRIPTION OF THE INVENTION

Figure 1:
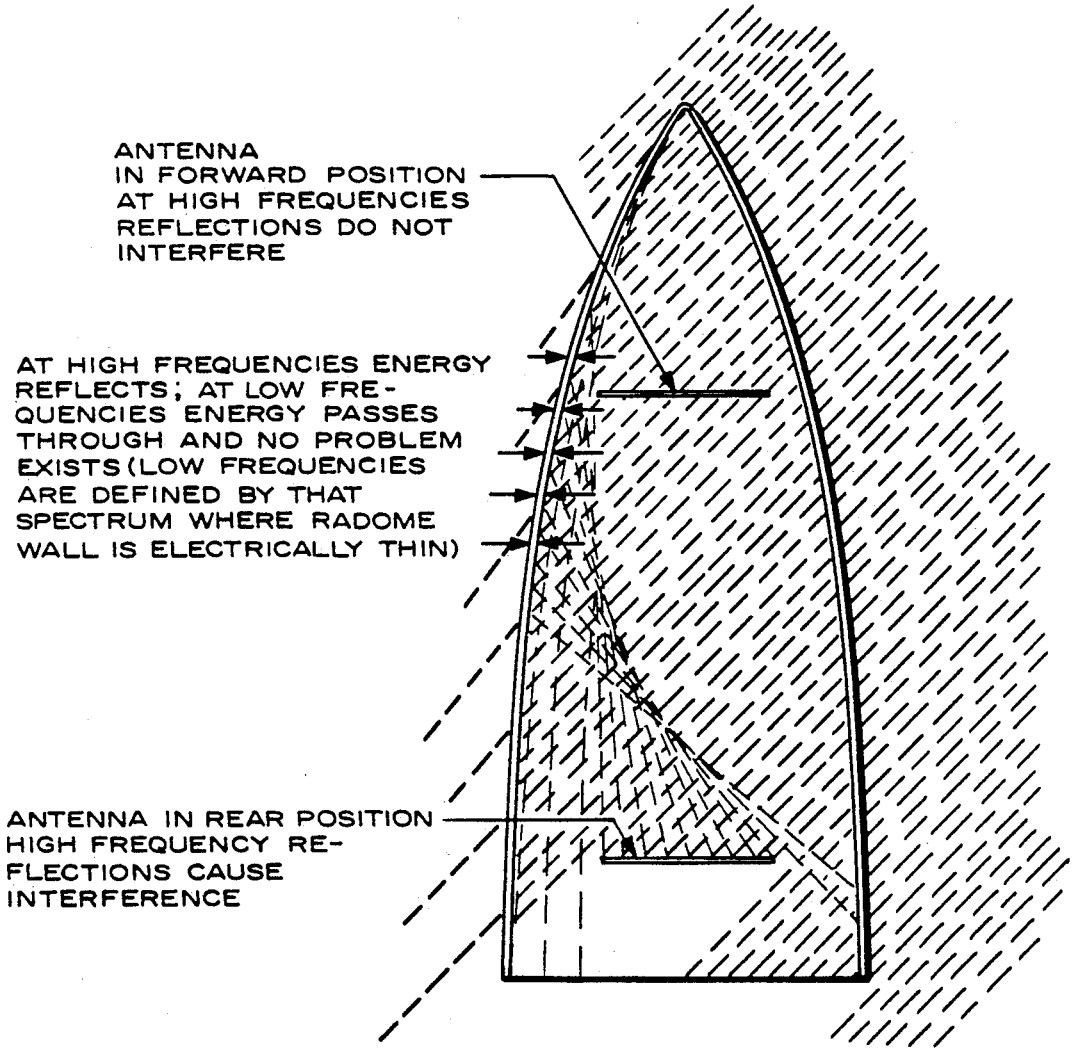
FIG. 1 illustrates the radome problem.

FIG. 1 illustrates the radome problem. From the figure, it is seen that the primary source of error is the reflections that occur internally within the radome for critical off-axis target angles. These reflections cause an interference between the direct path and reflected path energy if the antenna is located in aft position within the radome as illustrated. The critical angle is polarization sensitive. For narrow bandwidth, the wall of the radome can be tuned and the position of the antenna within the radome optimized. However, for true continuous multi-octave coverage these techniques are not entirely satisfactory.

At C-band and higher frequencies, where the reflection problem manifests itself, the reflections pass around the active region as indicated. Good quality patterns inside ceramic nose cones have been recorded to X-band.

Figure 2:
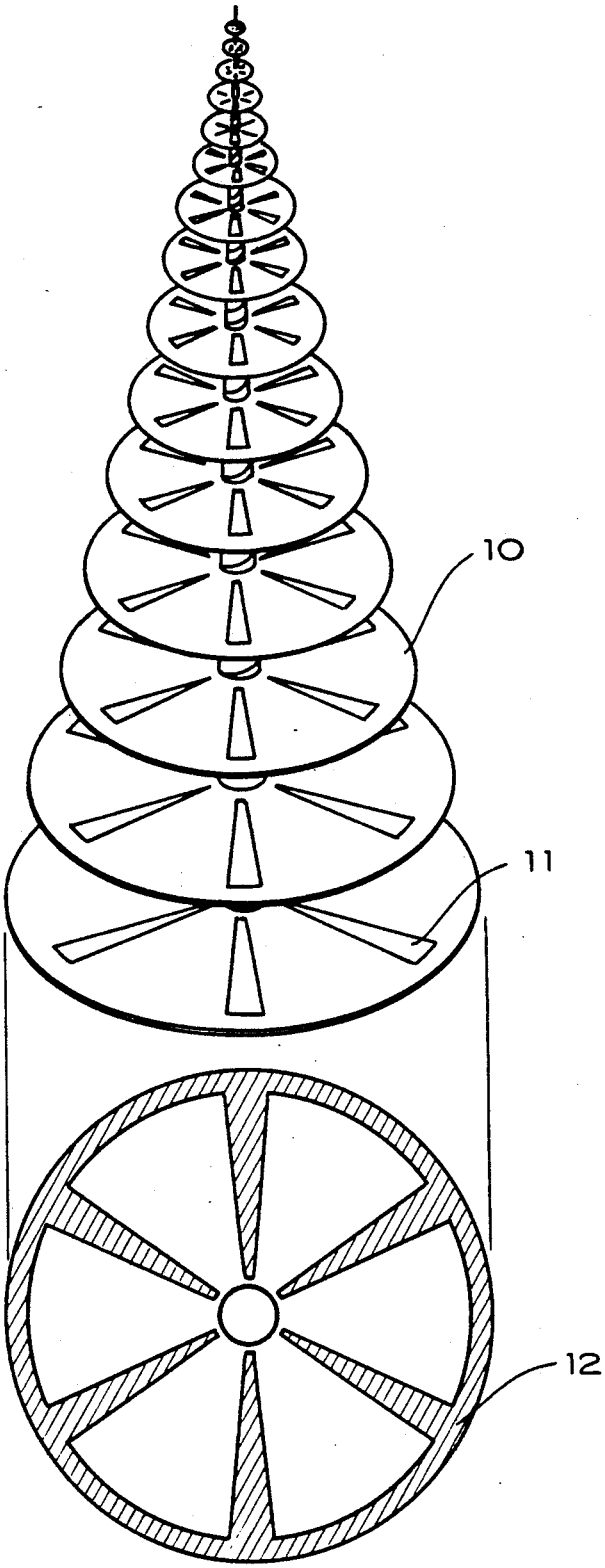
FIG. 2 illustrates the log periodic radial arm-coupled loop antenna.

FIG. 2 illustrates the log periodic radial arm-coupled loop antenna used in the present invention wherein the highest frequencies radiate from a point near the tip of the radome and progressively lower frequencies radiate closer to the base of the radome. This alleviates the radome problem for the most part. The construction of the antenna of FIG. 2 is not illustrated in detail in the present application in that it is disclosed and discussed in copending application Ser. No. 151,480, filed June 9, 1971 by Robert G. Corzine. Briefly, however, the individual elements indicated at 10 are mounted on a tapered aluminum shaft (not shown). Spacing between the individual elements is coated with a suitable dielectric material. Conductors, (not shown) are only connected to the driven elements indicated at 11 and are aligned down the support shaft on the dielectric. The loops indicated at 12 for one element, are capacitively coupled to the radials 11 on the front side.

Individual elements 10 are made from circuit board material and popped into a circumferential slot on the referred to tapered aluminum shaft.

In operation, the driven elements 11 radiate the sum mode while the capacitively coupled loops radiate the difference mode.

The second problem, coupling between the antenna and the missile body, comes into being at those low frequencies where the antenna becomes electrically small and inefficient. This region occurs when the antenna aperture is less than $2/\pi$ wavelengths in diameter. While the antenna efficiency is decreasing very rapidly with decreasing frequency in this region, the airframe itself is becoming a very efficient radiator, being on the order of several wavelengths in length and indeed, even being resonant at some particular frequencies in the band. Theoretically, it is possible, if the antenna is symmetrical and rigidly attached to the airframe, to feed the antenna in such a manner that the airframe induced currents cancel out. With a gimbaled seeker, as has been used previously, this would not seem to be completely possible as any gimbaling action would destroy the symmetry and current balance. Under these conditions, the resulting patterns would more than likely be more a function of the airframe than the antenna because of their relative radiation efficiency.

Figure 3:
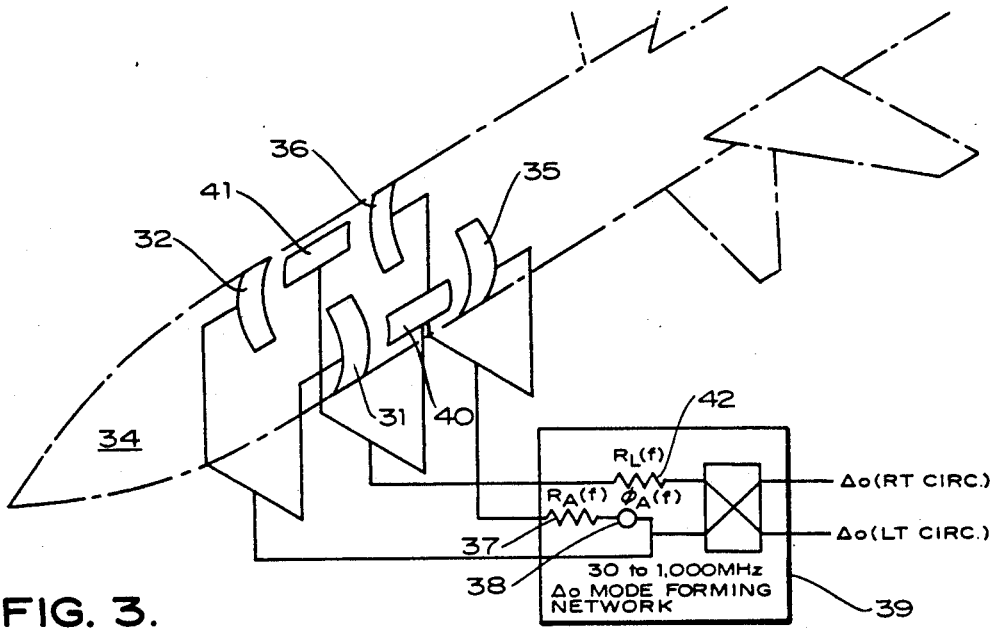
FIG. 3 illustrates the body canceled current array.

FIG. 3 illustrates one technique for achieving a body canceled current array. Two forward annular slots 31 and 32 on opposite sides of the missile body 34 are excited in phase to produce a pattern with a null on axis and an E field perpendicular to the missile body, i.e. radial. This excites longitudinal current flow on the airframe and therefore the pattern will be primarily due to the body as opposed to the slots because of their relative radiation efficiencies. Two aft annular slots 35 and 36 are excited in a similar manner with similar results.

The forward annular slot pair 31 and 32 and the aft annular slot pair 35 and 36 are combined in the proper amplitude and phase by means of a frequency dependent attenuator $R_A(f)$ 37 and phase shifter $\phi_A(f)$ 38 that cause the airframe longitudinal currents caused by each slot pair to cancel out. Therefore, the combined annular slot pattern is a function of the slots only.

A midpair of longitudinal slots 40 and 41 are excited in phase to produce a pattern with a null on axis and an E field parallel to the missile body, i.e. circumferential. The midslot pair is attenuated by $R_L(f)$ 42 to the same level as the fore and aft annular slot pairs.

Since the annular and longitudinal slot patterns are orthogonal and equal in magnitude, circular polarization of either sense can be obtained by combining them in a quadrature hybrid. It is possible to achieve patterns to below 70 MHz on missile sized airframes.

The circularly polarized, zero order mode ($\Delta_0$) monopulse difference mode pattern produced by the slot array is independent of the missile body. More importantly, its phase and amplitude characteristics are compatible with the fixed body two-channel monopulse antenna approach.

Figure 4:
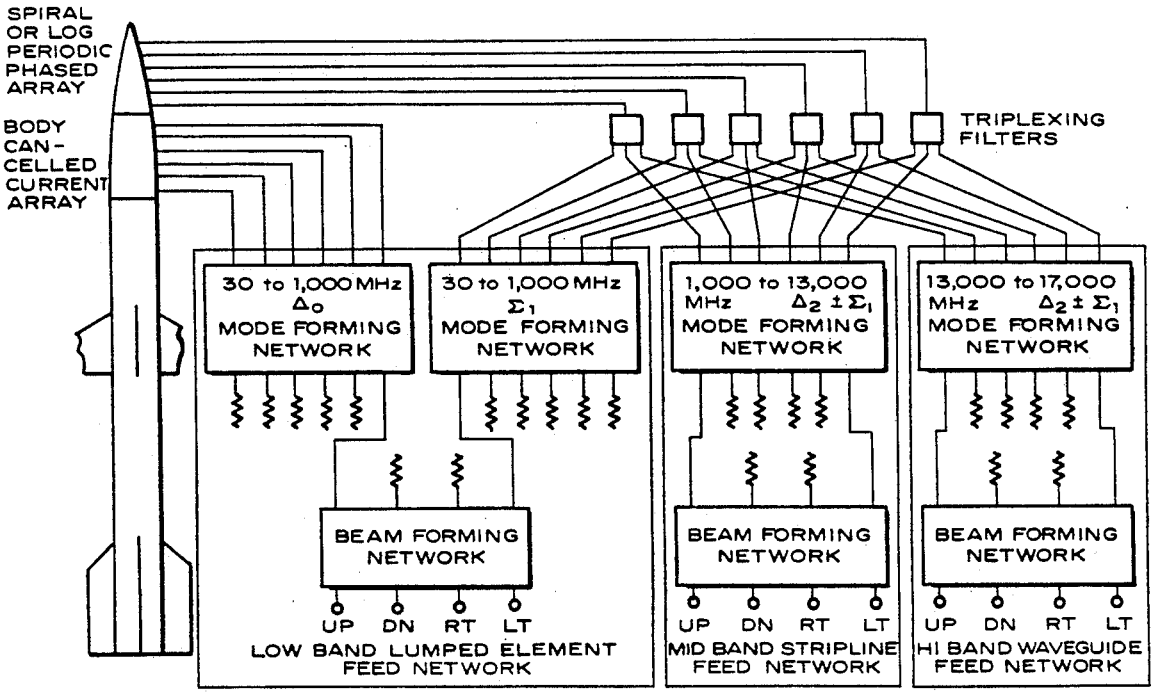
FIG. 4 illustrates the mode forming and beam forming networks associated with the antenna system.

FIG. 4 illustrates how the slot and log periodic radial arm-coupled loop systems can be combined to produce a VHF through K-band, polarization diversity monopulse ARM antenna. The details of the feed networks and mode forming networks are not gone into in detail in that they constitute state-of-the-art technology. The same applies with regard to the triplexing filters.

Figure 5:
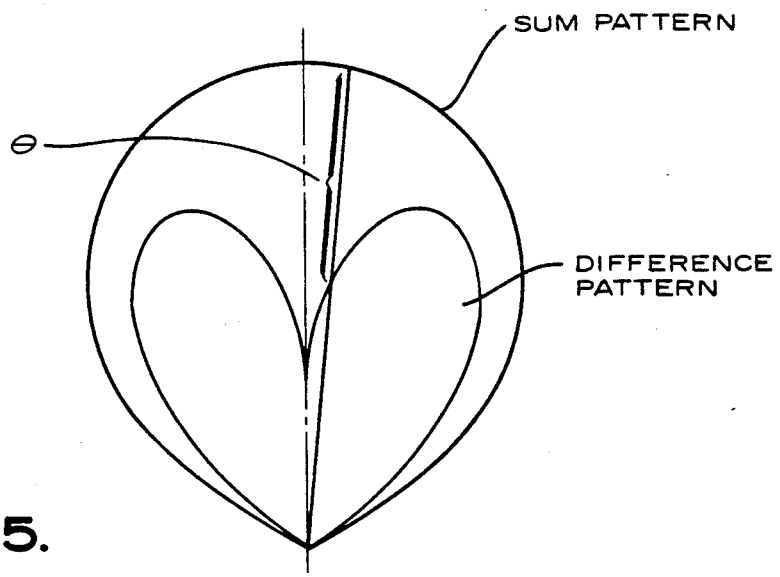
FIG. 5 illustrates relative amplitudes of the sum and difference mode patterns using the present antenna system.

In operation, at frequencies above 1,000 MHz the log periodic radial arm-coupled loop is phased to excite a sum ($\Sigma_1$) mode and difference ($\Delta_2$) mode simultaneously. The $\Sigma_1$ mode has a maximum on boresight, is circularly polarized and has rotational symmetry about the missile longitudinal axis. The $\Delta_2$ mode has a null on boresight, and is also circularly polarized and symmetrical about the missile longitudinal axis. Such a pattern is illustrated in FIG. 5.

Figure 6:
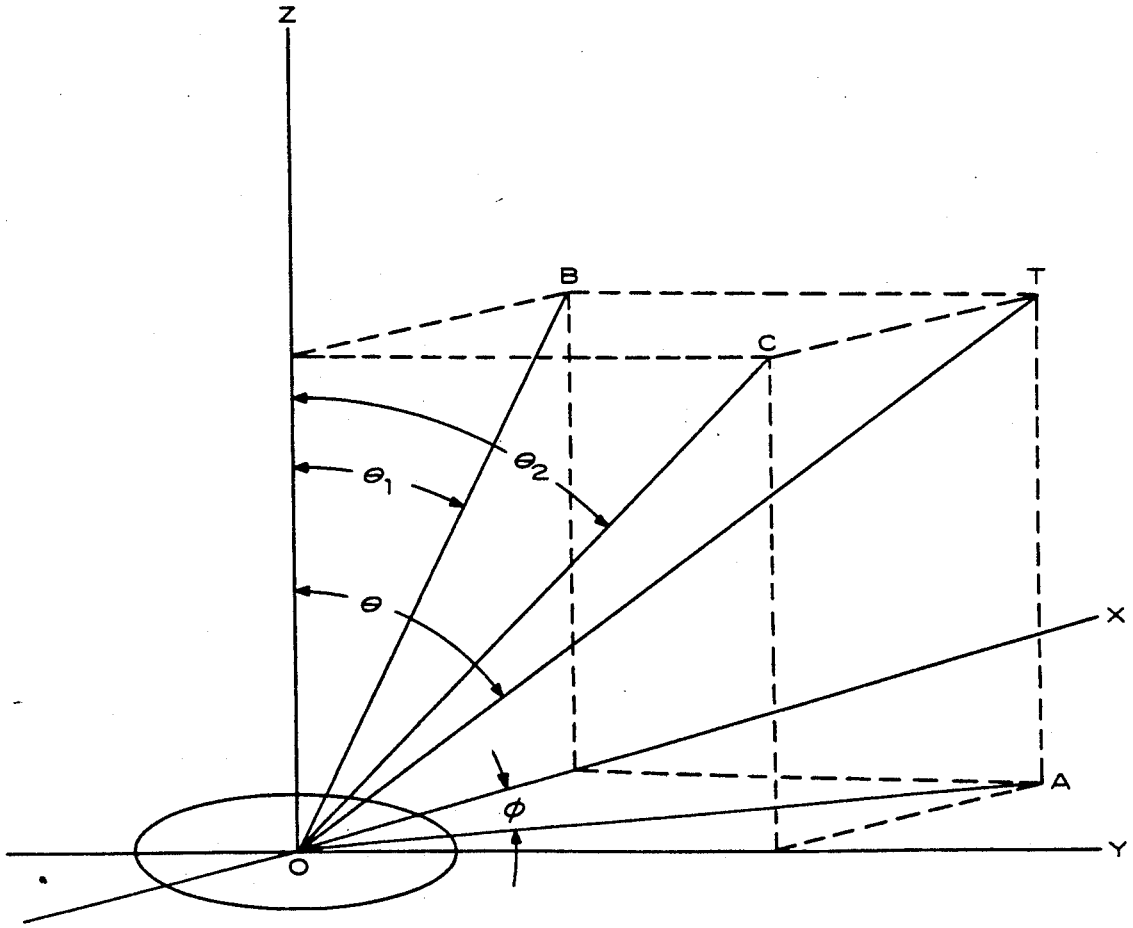
FIG. 6 illustrates the coordinate system used.
Figure 7:
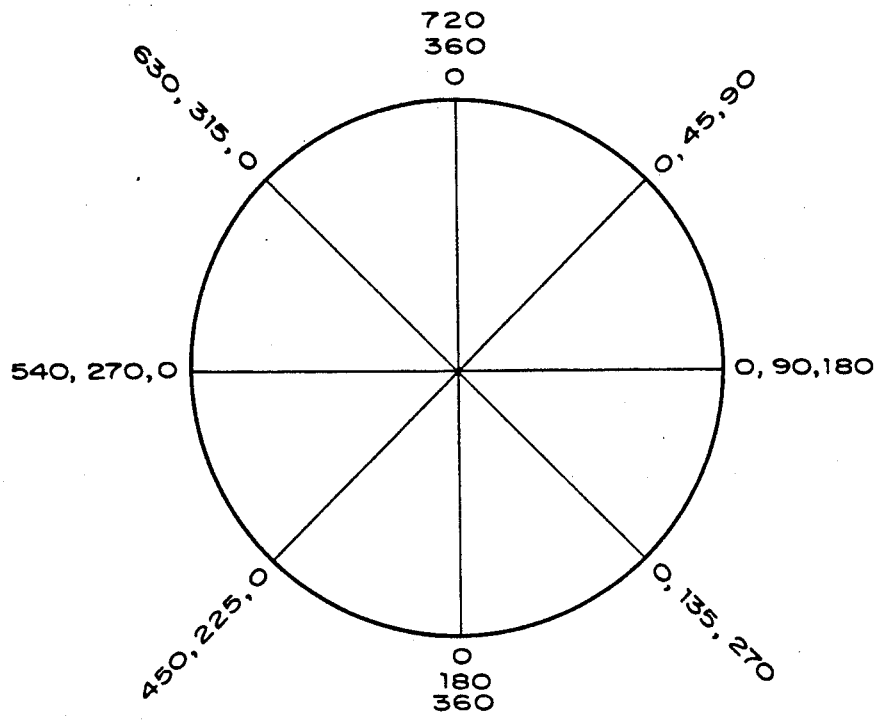
FIG. 7 illustrates the far field phase patterns for the sum and difference modes involved.
Figure 8:
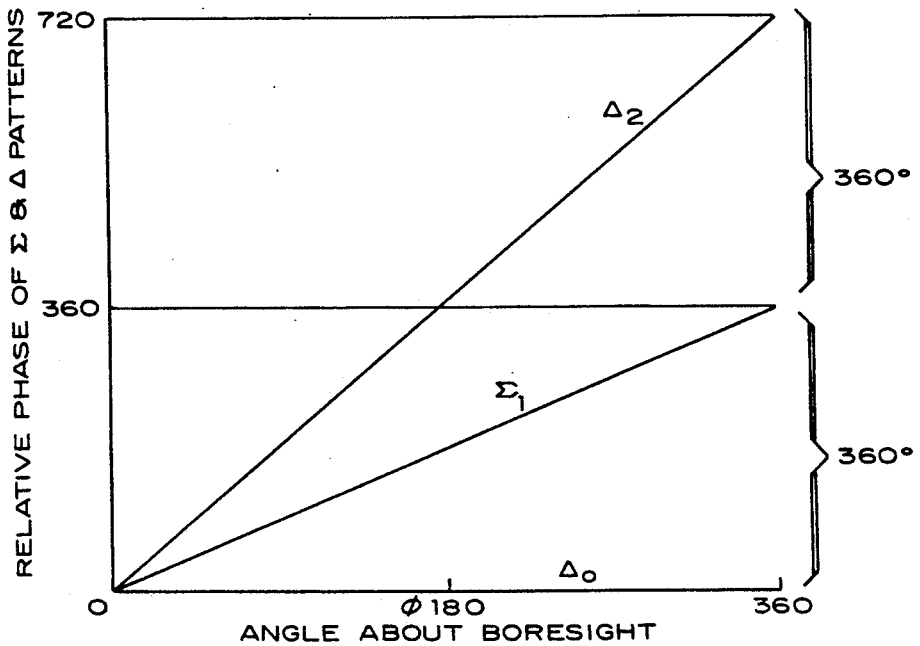
FIG. 8 is a graph of relative phase of the sum and difference patterns versus angle about boresight axis.

Referring to FIGS. 4 and 6, in the 1,000 to 17,000 MHz frequency ranges the angle $\theta$ is measured by comparing the amplitude of $\Sigma_1$ and $\Delta_2$ directly. The angle $\phi$ is measured by comparing the phase of $\Sigma_1$ and $\Delta_2$. This can be accomplished because the $\Sigma_1$ has a one wavelength or 360 degree phase progression (subscript notation) and the $\Delta_2$ mode a two wavelength or 720 degree phase progression around the missile axis in the far field. Therefore, the difference in phase between $\Sigma_1$ and $\Delta_2$ is directly proportional to $\phi$ as required. This is illustrated in FIG. 7 wherein the far field phase relationships are set forth for the $\Sigma_1$, $\Delta_2$ and $\Delta_0$ modes. FIG. 8 illustrates the graphical relationship between the angle about boresight in the far field and the relative phase of the sum and difference patterns. It is noted that the radial arm-coupled loop is given as an example but that it could be replaced with a multimode planar spiral, a log periodic dipole phased array, or a multimode conical spiral. All of these types of two-channel monopulse antennas would have patterns whose amplitude and phase characteristics would make them compatible with combining with the body canceled current array as described herein.

In the frequency range of 30 to 1,000 MHz the log periodic radial arm-coupled loop is phased to excite the $\Sigma_1$ mode only. The slot or body canceled current array is excited in the $\Delta_0$ mode as previously described. The amplitude of $\Sigma_1$ and $\Delta_0$ are compared to determine the angle $\theta$. In that the $\Sigma_1$ mode has a 360 degree phase progression and $\Delta_0$ mode has a zero degree phase progression in the far field, the difference in phase between $\Sigma_1$ and $\Delta_0$ is again directly proportional to $\phi$ as required.

Figure 9:
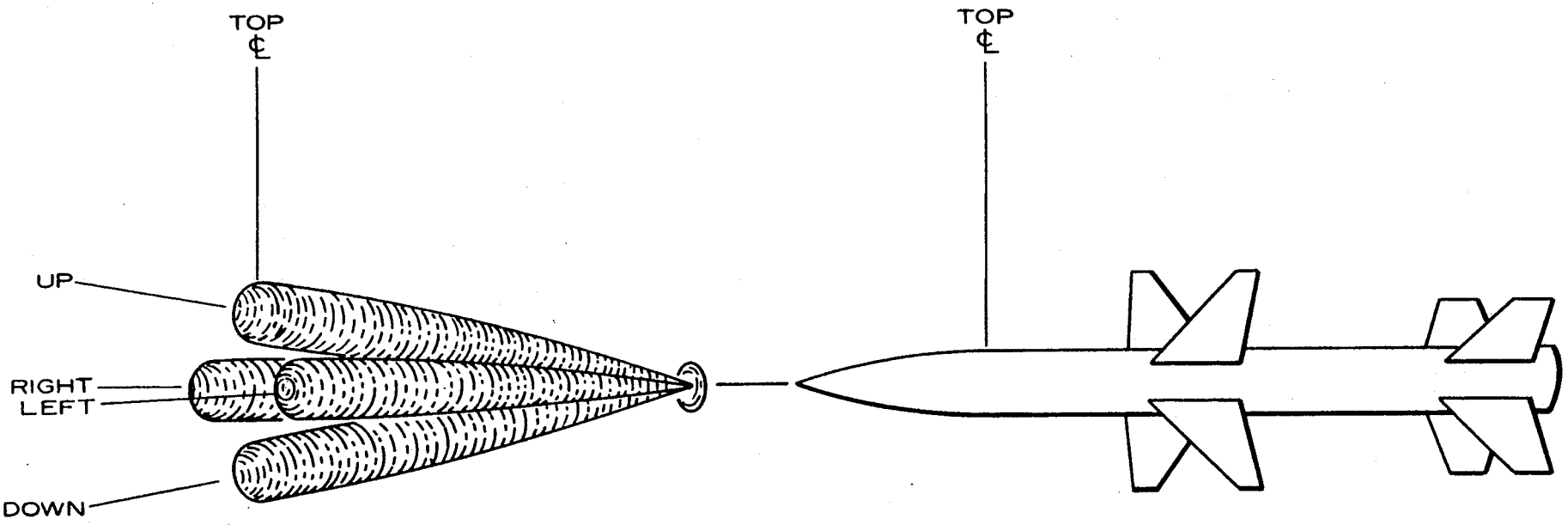
FIG. 9 illustrates the pattern configuration at the output of the beam forming network.

The beam forming networks shown in FIG. 4 provide a coordinate transformation as is known in the prior art. This allows the angles measured by the antenna system to the $\theta_1$ and $\theta_2$ as defined in FIG. 6 as opposed to $\phi$ and $\theta$. Consequently, the resulting antenna pattern at the output of the four individual beam forming network terminals correspond to "squinted beams" as illustrated in FIG. 9. Conventional amplitude comparison monopulse techniques can be used to process these "UP, DOWN, LEFT, RIGHT" outputs.

Disclosed is a low cost antenna system and radome to provide continuous frequency coverage continuous through X-band. Additionally, the system can be designed to exhibit polarization diversity characteristics, if required, using conventional techniques.

What is claimed is:

1. A directional receiving antenna system for use in a vehicle for receiving electromagnetic signals comprising;

a radiating structure constructed such that highest frequencies radiate from a point near one end of the structure and progressively lower frequencies radiate closer to the other end of the structure positioned in said vehicle; and another radiating structure located in said vehicle constructed such that the vehicle body itself forms an efficient radiating structure in the region where antenna aperture is less than $2/\pi$ wavelengths in diameter; said radiating structures cooperating to provide true continuous multi-octave microwave direction finding capability as the receiving antenna system.

2. A directional receiving antenna system as set forth in claim 1 wherein;

said another radiating structure comprises a body canceled current array.

3. A directional receiving antenna system as set forth in claim 1;

said first mentioned radiating structure is a log periodic loop.

4. A directional receiving antenna as set forth in claim 2 wherein;

said body canceled current array comprises annular slots in said vehicle body.

* * * * *